United States Patent [19]

Sato et al.

[11] Patent Number: 5,012,266

[45] Date of Patent: Apr. 30, 1991

[54] APPARATUS FOR PROCESSING LIGHT-SENSITIVE MATERIALS

[75] Inventors: Kiyoshi Sato; Shinichi Ohtani; Mikio Kawasaki, all of Tokyo, Japan

[73] Assignee: Konica Corporation, Tokyo, Japan

[21] Appl. No.: 555,060

[22] Filed: Jul. 18, 1990

[30] Foreign Application Priority Data

Jul. 28, 1989 [JP] Japan ..... 1-195647

[51] Int. Cl.[5] ..... G03D 5/04

[52] U.S. Cl. ..... 354/319; 354/325

[58] Field of Search ..... 354/320, 321, 322, 324, 354/325, 319; 134/64 P, 122 P; 226/170, 171, 172, 173

[56] References Cited

U.S. PATENT DOCUMENTS 3,785,269 1/1974 Morioka ..... 354/322

4,232,691 11/1980 Grant ..... 354/322

*Primary Examiner*—A. A. Mathews

*Attorney, Agent, or Firm*—Frishauf, Holtz, Goodman & Woodward

[57] ABSTRACT

The invention provides an apparatus for processing a sheet-shaped silver halide photographic light sensitive material having a hydrophilic colloidal layer on a substrate without dipping it in a processing solution in a tank. In the apparatus, there are provided a conveying device having a pair of conveying belts disposed to face each other with a gap, wherein the gap is made so that the pair of conveying belts hold the developing solution therebetween. Accordingly, the conveying device conveys the sheet-shaped material with the developing solution between the pair of conveying belts.

3 Claims, 1 Drawing Sheet

APPARATUS FOR PROCESSING LIGHT-SENSITIVE MATERIALS

BACKGROUND OF THE INVENTION

The present invention relates to an apparatus for processing light-sensitive materials which processes an exposed silver halide photographic light-sensitive material having therein a hydrophilic colloidal layer.

A silver halide photographic light-sensitive material having therein a hydrophilic colloidal layer is processed by an automatic processor wherein, for example, a silver halide photographic light-sensitive material is dipped, for processing, in a developing solution in an sufficient amount contained in a developing tank for a predetermined period of time, while the silver halide photographic light-sensitive material is conveyed through a roller type conveyance mechanism.

Due to the processing of silver halide photographic light-sensitive materials, the effective components in the developer contained in a developer tank are consumed, resulting in deterioration of the developer caused by fatigue thereof. Further, the developer is deteriorated when the developer absorbs carbon dioxide in air in the course of time for neutralizing reaction and thus the alkalinity is reduced as in the case of alkaline developer, or the developer is deteriorated by fatigue with the passage of time caused by oxidization created by oxygen.

As a method for recovering fatigue of the developer, Japanese Patent Publication Open to Public Inspection Nos. 144502/1975, 62004/1979, 115039/1980 and 12645/1981 (hereinafter referred to as Japanese Patent O.P.I. Publication) disclose means of recovering fatigue of the developer by replenishing developer replenisher continuously or intermittently depending upon the amount of processing.

In the aforesaid means, however, the components in the developer at the initial stage are different from those of the developers used thereafter, resulting in photographic processing in which the characteristic of each processing based on each replenishing of the developer differs each time in the strict sense of the word, and thus the finished photographic quality is unstable.

Consequently, there may be considered a method wherein an exposed side of a silver halide photographic light-sensitive material is supplied with the developer for processing instead of that the silver halide photographic light-sensitive material is dipped in the developer contained in a developer tank. In this case, however, it is necessary to convey the silver halide photographic material and to supply a small amount of developer uniformly.

When processing by supplying a small amount of developer, however, supply of the developer tends to be uneven, causing streaks and uneven processing, thus resulting in the problems that photometric characteristics such as predetermined sensitivity and gradient are not obtained.

SUMMARY OF THE INVENTION

The invention is based on the real situations mentioned above and its object is to provide an apparatus for processing light-sensitive materials capable of supplying sufficient amount of developer and thereby performing stable processing without streaks, thus offering photometric characteristics such as predetermined sensitivity, gradient and so on.

In order to solve the problems mentioned above, the invention is represented by an apparatus for processing light-sensitive materials that processes a silver halide photographic light-sensitive material having on both sides of its support hydrophilic colloidal layers, by supplying the hydroquinone-containing developer onto the exposed side of the silver halide photographic light-sensitive material without dipping it in the developer, wherein there is provided a processing device which holds, on a sandwiched basis, the developer on the exposed side of aforesaid silver halide photographic light-sensitive material and conveys it for processing.

The silver halide photographic light-sensitive material mentioned above is, for example, a high-speed X-ray film having at least hydrophilic colloidal layers on both sides of its support which is made of a transparent material. As a silver halide photographic light-sensitive material mentioned above, the one disclosed in Japanese Patent O.P.I. Publication No. 23154/1988 applied previously by an assignee of the invention is preferably used because it is excellent in sensitivity, fog and graininess and has less abrasion mark and less desensitization by pressure despite less amount of gelatin.

For supplying a developer onto both sides of a silver halide photographic light-sensitive material, it is preferable to supply it while conveying the silver halide photographic light-sensitive material, and its conveyance may either be in horizontal or in vertical direction. The conveyance in vertical direction is more preferable because it requires less floor space for installation of an apparatus.

Further, without being dipped in the developer contained in a tank, the silver halide photographic light-sensitive material can be supplied on its exposed surface with the developer, and it is possible, through such supply of the developer, to supply the necessary amount of the developer and to avoid the fatigue of the developer with the passage of time, resulting in saving of developers.

This method of supplying developers may be in the style of either developer coating, developer shower or developer spray, and such supply is not limited to only once but it may be repeated several times.

As hydroquinone used in the invention, there may be given hydroquinone, chlorohydroquinone, methylhydroquinone and others, but hydroquinone is used preferably. The amount of the hydroquinone to be added is 1 g–20 g per one liter of developer and 5 g–15 g is more preferable.

In addition to the foregoing, the developer of the invention may also be supplied, when necessary, with a developing agent of a 3-pyrazolidone type, a hardening agent of a dialdehyde type, an antifogging agent selected from the group of indazole, benzimidazole, benztriazole and mercaptothiazole, a sequestering agent, a buffering agent, an alkaline agent, an auxiliary agent for dissolution, a pH-adjusting agent, a development accelerator and a surface active agent.

Between a silver halide photographic light-sensitive material and a portion in the mechanism in the invention, there is a clearance which can hold a developing solution on the exposed surface of the light-sensitive material owing to surface tension of the developing solution, and further, the developing solution may either be supplied directly to the silver halide photographic light-sensitive material or be supplied indirectly through the supply by means of the processing mechanism.

In the processing mechanism in the invention, the silver halide photographic light-sensitive material having on the both sides of its support hydrophilic colloidal layers is conveyed and processed under the condition that the developing solution containing hydroquinones is held, owing to its surface tension, on the exposed surface of the silver halide photographic light-sensitive material. Therefore, the silver halide photographic light-sensitive material, without being dipped in the developer, can be developed stably without any streak problems with a small amount of developer, resulting in the achievement of photometric characteristics such as predetermined sensitivity and gradient.

PREFERRED EMBODIMENT

Figure 1:
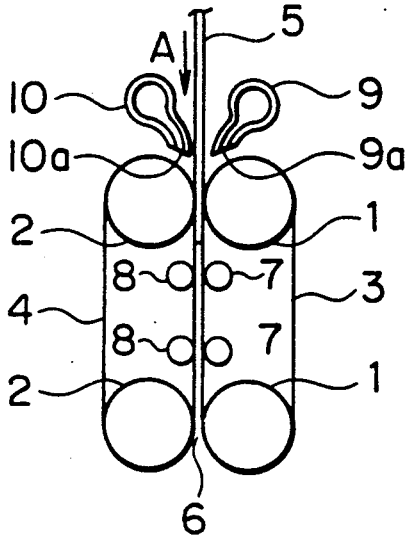
FIG. 1 is a diagram of an apparatus for processing light-sensitive materials wherein an example of the invention is applied and FIG. 2 is an enlarged diagram of the processing mechanism.

An example of the invention will be explained in detail, referring to aforesaid drawings.

In the apparatus for processing light-sensitive materials, a pair of rollers 1 and 1 and a pair of rollers 2 and 2 each pair being arranged vertically are provided with a predetermined distance therebetween, and endless belts 3 and 4 are spread over rollers 1 and 1 and rollers 2 and 2 respectively. Between these endless belts 3 and 4, there is provided transport path 6 for silver halide photographic light-sensitive material 5. These rollers 1 and 1 and rollers 2 and 2 are driven by an unillustrated motor, and between endless belts 3 and 4, there is formed a processing mechanism which transports and processes a silver halide photographic light-sensitive material while holding it together with a developer so that the developer is held on the exposed surface of the silver halide photographic light-sensitive material.

These endless belts 3 and 4 are made, for example, of the material such as synthetic rubber or synthetic resin and it is preferable that the material can easily offer the flatness of the belt and has the surface wettability, though there is no particular restriction. It may also be possible to use porous material because it is required to hold a developer.

Figure 2:
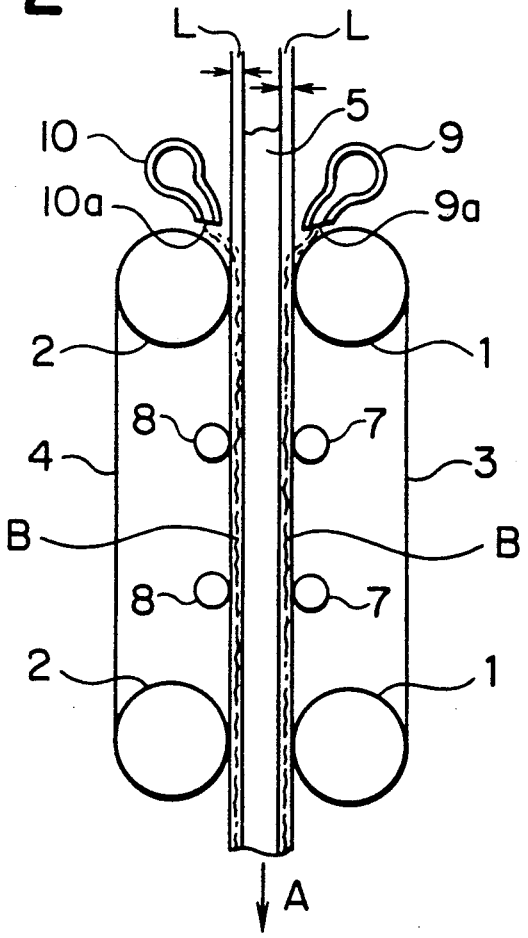

Between endless belt 3 and silver halide photographic light-sensitive material 5 and between endless belt 4 and silver halide photographic light-sensitive material 5, there are respectively provided, as shown in FIG. 2, clearances L capable of holding a developer on the exposed surface owing to surface tension. Further, there are provided guide means 7 and 8 which control the deviation of endless belts 3 and 4 so that the clearance between silver halide photographic light-sensitive material 5 and endless belt 3 and the clearance between silver halide photographic light-sensitive material 5 and endless belt 4 may be constant, thereby achieving the uniform holding of developer.

On the side of the processing mechanism where silver halide photographic light-sensitive material 5 is fed in, there are provided supply ports 9*a* and 10*a* of respective supply nozzles 9 and 10 toward the contact face between endless belt 3 and silver halide photographic light-sensitive material 5 and the contact face between endless belt 4 and silver halide photographic light-sensitive material 5 respectively. Incidentally, the developer can be supplied directly to silver halide photographic light-sensitive material 5 or indirectly to it from endless belts 3 and 4 which are first supplied with the developer.

From supply nozzles 9 and 10, fresh developers are supplied to silver halide photographic light-sensitive material 5 and then are drained from the bottom of the processing mechanism to be a disposable developer.

Incidentally, it is also possible to install a tray at the bottom of the processing mechanism so that the used developer may be collected into the tray and then the developer in the tray can be circulated to supply nozzles by means of a pump and piping connected to the tray. In this case, the developer is not fatigued with development and the developer circulated is not fatigued on standing with the absorption of carbon dioxide either because of a few air-contacting area, thus allowing itself to be used again.

Therefore, silver halide photographic light-sensitive material 5 is transported by endless belts 3 and 4 in the direction of an arrow A, and developers B are supplied from supply ports 9*a* and 10*a* of respective supply nozzles 9 and 10 while silver halide photographic light-sensitive material 5 is being transported. Each developer B is held, owing to surface tension, in each of the clearance L between one side of silver halide photographic light-sensitive material 5 and endless belt 3 and the clearance L between the other side of silver halide photographic light-sensitive material 5 and endless belt 4.

Accordingly, it is possible to supply sufficient developer B uniformly onto the exposed surface of silver halide photographic light-sensitive material 5, thereby allowing it to be processed while it is being transported. Thus, it is possible to process stably without any streaks and to obtain predetermined sensitivity and gradient.

As stated above, silver halide photographic light-sensitive material having on the both sides of its support hydrophilic colloidal layers is conveyed and processed under the condition that the developing solution containing hydroquinones is held, owing to its surface tension, on the exposed surface of the silver halide photographic light-sensitive material in the apparatus for processing light-sensitive material of the invention. Therefore, the silver halide photographic light-sensitive material, without being dipped in the developer, can be developed stably without any streak problems with a small amount of developer, resulting in the achievement of photometric characteristics such as predetermined sensitivity and gradient.

What is claimed is:

1. An apparatus for processing a sheet-shaped silver halide photographic light sensitive material having a hydrophilic colloidal layer on a substrate, comprising:

feed means for feeding developing solution containing hydroquinones;

conveying means including a pair of conveying belts disposed to face each other with a gap, wherein the gap is made so that the pair of conveying belts hold the developing solution therebetween; and the conveying means conveying the sheet-shaped material with the developing solution between the pair of conveying belts.

2. The apparatus of claim 1, wherein the pair of conveying belts are disposed vertically.

3. The apparatus of claim 2, wherein the gap is made so that the developing solution is held by the work of surface tension between the pair of conveying belts.

* * * * *